US005318640A

United States Patent [19]

Ishii et al.

[11] Patent Number: 5,318,640

[45] Date of Patent: Jun. 7, 1994

[54] SURFACE TREATMENT METHOD AND COMPOSITION FOR ZINC COATED STEEL SHEET

[75] Inventors: Hitoshii Ishii; Kazuhiko Mori; Toshi Miyawaki; Shizuo Shima, all of Kanagawa, Japan

[73] Assignee: Henkel Corporation, Plymouth Meeting, Pa.

[21] Appl. No.: 916,096

[22] PCT Filed: Jan. 25, 1991

[86] PCT No.: PCT/US91/00531

§ 371 Date: Jul. 28, 1992

§ 102(e) Date: Jul. 28, 1992

[87] PCT Pub. No.: WO91/11542

PCT Pub. Date: Aug. 8, 1991

[30] Foreign Application Priority Data

Jan. 30, 1990 [JP] Japan ..... 2-19581

[51] Int. Cl.[5] ..... C23C 18/46

[52] U.S. Cl. ..... 148/264; 148/273

[58] Field of Search ..... 148/264, 267, 273

[56] References Cited

FOREIGN PATENT DOCUMENTS 3243282 10/1988 Japan ..... 148/264

2043376 2/1990 Japan ..... 148/264

*Primary Examiner*—Sam Silverberg

*Attorney, Agent, or Firm*—Ernest G. Szoke; Wayne C. Jaeschke; Norvell E. Wisdom, Jr.

[57] ABSTRACT

A nickel and/or cobalt deposition process which can be run at a nearly neutral pH and which rapidly deposits nickel and/or cobalt in quantities large enough to improve the paint adhesion and post coating corrosion resistance, and which has a good solution stability, is achieved by treating zinc coated sheet steel with an aqueous solution that has a pH between 5 and 10 inclusive and comprises (A) a total of at least 0.01 g/L of metal ions selected from the group consisting of $Ni^{2+}$ and $Co^{2+}$ ions and (B) a sufficient amount to fully complex the metal ions recited in part (A) of complexing agents selected from the group consisting of ammonia and organic compounds having at least one amino group in the neutral region.

The substitution precipitation reaction of nickel and cobalt is substantially accelerated by the presence, as a third component in addition to the metal ion and complexing agent, of at least one ionic species or compound selected from the nitrite ion, nitrate ion, thiocyanate ion, thiosulfate ion, thiourea, phosphite ion, hypophosphite ion, and perchlorate ion.

11 Claims, No Drawings

SURFACE TREATMENT METHOD AND COMPOSITION FOR ZINC COATED STEEL SHEET

TECHNICAL FIELD

The present invention relates to treating the surface of zinc coated steel, particularly sheet steel, e.g., electrogalvanized, electrolytic zinc-alloy plated, hot-dip galvanized, galvannealed, and/or zinc/aluminum alloy-plated steel, in order to deposit thereon nickel, cobalt, and/or compounds thereof, with the object of providing a surface which is an excellent underlayer for such subsequent coating operations as painting, laminating, ceramic coating, and the like. In concrete terms, the present invention is especially suited for the production of surface treated steel sheets (for example, painted steel sheet, laminated steel sheet, and surface treated car body panels) by coating or laminating either immediately after execution of treatment according to the present invention or after an intermediate chromating treatment or phosphating treatment.

BACKGROUND ART

It has long been known that the paint adhesion and post-coating corrosion resistance can be improved through chemical treatments in which a heavy metal and/or compound thereof is deposited on the surface of zinc coated steel sheet. Examples from the art in this regard are (1) Japanese Patent Publication Number 52-22618 (22,618/77] and (2) Japanese Patent Publication Number 43-12974 [12,974/68]. Both of these concern the deposition of a heavy metal, such as nickel, cobalt, iron, or the like, onto galvanized steel sheet. Heavy metal or oxide thereof is deposited onto zinc coated steel sheet by treatment in the acidic range at pH 2 according to the invention of reference (1) and by treatment in the alkaline range at a pH of at least 11 according to the invention of reference (2). A disadvantage accruing to each of these prior art references is the occurrence of excessive etching of the zinc (an amphoteric metal) by the $H^+$ ion or $OH^-$ ion. This results in a degradation in the performance of the end product, for example, a decline in corrosion resistance.

Thus, methods are already known for improving the adhesion of coatings (e. g., paints, laminates, ceramic coatings, etc.) to the substrate through the substitution precipitation of cobalt or nickel onto zinc coated steel sheet, but in each case the prior treatment solution, being acidic or alkaline, etches the zinc substrate too much, with a resulting decline in performance, for example, in corrosion resistance. On the other hand, while excessive etching does not occur in the neutral pH region, the corresponding rate of metal substitution precipitation is so slow as to be useless for practical applications.

DESCRIPTION OF THE INVENTION

Problem to Be Solved by the Invention

The principal goal of the invention is the development of a nickel and/or cobalt deposition process which could be run at a nearly neutral pH but which would nevertheless be rapid, which deposits nickel and/or cobalt in quantities large enough to improve the paint adhesion and post coating corrosion resistance, and which has a good solution stability.

SUMMARY OF THE INVENTION

It was discovered that one or more compounds selected from among ammonia and amine compounds which carry at least one amino group, or preferably at least two amino groups, constitute an excellent complexing agent for the substitution precipitation of nickel and/or cobalt from a treatment solution in the neutral region. Said complexing agents have a good stability with metal ion in the neutral region and support the rapid deposition of quantities sufficient to improve the paint adhesion and post coating corrosion resistance. Examples of amine compounds which carry at least one amino group are: ethylenediamine, triethylenediamine, N-methylenediamine, N-n-propylethylenediamine, N,N-dipropylethylenediamine, 1,2-diaminopropane, meso-2,3-diaminobutane, meso-2,3-diaminobutane, cis-2,3-diaminocyclohexane, trans-1,2-diaminocyclohexane, trans-1,2-diaminocycloheptane, diethylenetriamine, triethylinetetramine, and various amino acids.

The substitution precipitation reaction of nickel and cobalt is substantially accelerated by the presence, as a third component in addition to the metal ion and complexing agent, of at least one ionic species or compound selected from the nitrite ion, nitrate ion, thiocyanate ion, thiosulfate ion, thiourea, phosphite ion, hypophosphite ion, and perchlorate ion.

The corrosion resistance of zinc coated steel sheet is improved by the execution of a surface treatment, such as a chromating treatment, phosphating treatment, or blackening treatment, on zinc coated steel sheet after its treatment using a treatment solution as described above; and this provides a surface specifically optimized as an undercoating for painting, laminate coating, and ceramic coating.

DETAILS OF PREFERRED EMBODIMENTS OF THE INVENTION

The total concentration of both $Ni^{2+}$ and $Co^{2+}$ ions in the treatment liquid of the present invention (abbreviated below as the "present treatment liquid") should preferably be 0.01 to 30 grams per liter ("g/L") and more preferably is 0.02 to 15 g/L. Values below 0.01 g/L are usually impractical because the deposition rate is too slow, while values in excess of 30 g/L are economically disadvantageous because the deposition rate becomes saturated. While the $Ni^{2+}$ and $Co^{2+}$ can be supplied in the form of the metal, they are advantageously furnished in the form of their salts, e.g., the sulfate, chloride, oxide, hydroxide, carbonate, nitrate, etc.

A component indispensable to the substitution precipitation of nickel and/or cobalt from the treatment liquid in the neutral region is a complexing agent which exhibits good stability with metal ion in the neutral region and which supports the rapid deposition of quantities sufficient to improve the paint adhesion and post-coating corrosion resistance. Such a complexing agent takes the form of one or more compounds selected from ammonia and amine compounds which have at least one amino group, preferably at least two amino groups, as specifically exemplified by ethylenediamine, triethylenediamine, N-methylenediamine, N-n-propylethylenediamine, N,N-dipropylethylenediamine, 1,2-diaminopropane, meso-2,3-diaminobutane, rac-2,3-diaminobutane, cis-2,3-diaminocyclohexane, trans-1,2-diaminocyclohexane, trans-1,2-diaminocycloheptane, diethylenetriamine, triethylenetetramine, and various amino acids. These must be added in quantities sufficient to complex the nickel and cobalt. Thus, for example, when $Ni^{2+}$ and ammonia are present in the aqueous solution, the nickel/ammonium complex takes the form of $(NI(NH_3)_6)^{2+}$, and at least six times as much ammonia must be added on a molar basis as $Ni^{2+}$. One should note that, within the context of the present invention, these complexing agents do not exercise a particularly adverse effect even when present in quantities in excess of that theoretically necessary to complex the $Ni^{2+}$ and $Co^{2+}$. Their upper limit will be established by the economics and solubilities.

The present treatment liquid advantageously contains a metal deposition-accelerating component in an amount of 0.001 to 50 g/L, more preferably 0.05 to 20 g/L, of material selected from nitrite ions, nitrate ions, thiocyanate ions, thiosulfate ions, thiourea, phosphite ions, hypophosphite ions, and perchlorate ions. The accelerating effect is normally inadequate at less than 0.001 g/L, while values in excess of 50 g/L are uneconomical because the effect becomes saturated. In concrete terms, thiourea will be added as such, while the other selections may be added as their alkali metal or ammonium salts. The presence of these compounds achieves the advantage of increasing the catalytic oxidation activity of the complex itself. This activity is believed to accelerate zinc elution from the surface of the metal being treated, which supports the rapid deposition onto this metal surface of nickel or cobalt from the complexes having nickel or cobalt as the central metal element.

The treatment bath according to the present invention may be maintained at any temperature within the range from room temperature to its boiling point, and it should be contacted with the zinc coated steel sheet for the time necessary to develop the desired quantity of metal deposition. The application method here may comprise, for example, immersion, spraying, flow coating, roll coating, and brush coating.

With regard to the quantity of metal deposition on the zinc-basis-plated steel sheet, that is, the suitable range for the quantity of (Ni+Co) deposition, this will depend on the ultimate objective, but the general range is approximately 0.1 to 1,000 milligrams per square meter of surface treated ("$mg/m^2$").

After this treatment, water rinsing followed by drying will provide an undercoat suitable for adhesion or painting. The appropriate quantity of metal deposition in such cases is 2 to 150 $mg/m^2$. An improvement in the adhesive strength with the substrate is not usually obtained at values below 2 $mg/m^2$, while values in excess of 150 $mg/m^2$ are economically disadvantageous because the effect becomes saturated.

A surface strongly adapted as an undercoat for painting or lamination is obtained by execution of treatment with the treatment liquid of the present invention, followed by a water wash and then a chromate treatment. In this case, the preferable quantity of metal deposition is the same as for treatment with only the bath according to the present invention, i.e., 2 to 150 $mg/m^2$.

The development of black rust is a problem when a chromate treatment is used as a temporary or one-time rust preventive for zinc coated steel sheet rather than as an underlayer for coatings; however, the development of black rust can be prevented by treatment with liquid according to the present invention prior to the chromate treatment. In such a case, the preferred quantity of metal deposition is 0.1 to 5 $mg/m^2$. Values less than 0.1 $mg/m^2$– will not usually prevent the development of black rust, while exceeding 5 $mg/m^2$ diminishes the ability of the chromate to prevent white rust.

A surface advantageously adapted as an undercoating for such coating operations as painting and lamination may also be prepared by treatment with treatment liquid according to the present invention followed by a water wash and then a phosphating treatment. The preferred metal add-on in this case is the same as in chromate treatment at 2 to 150 $mg/m^2$.

Treatment with treatment liquid according to the present invention prior to a baked chromate type blackening treatment (as described in Japanese Patent Application Number 63-310542 (310,542/88)) can substantially improve the corrosion resistance and substrate adhesion of the baked chromate type blackening treatment film. In this case, the preferable deposition or add-on is 2 to 1,000 $mg/m^2$. Values below 2 $mg/m^2$ do not usually result in an improvement in adhesion or corrosion resistance, while values in excess of 1,000 $mg/m^2$ are economically disadvantageous because the further improvement in adhesion and corrosion resistance becomes minuscule.

The effect of the present invention will be concretely explained below with reference to illustrative and comparison examples.

EXAMPLES

I. Examples 1 through 10 concern the preparation of an undercoating for painting by treatment of galvanized steel sheet with treatment liquid according to the invention, followed by washing with water and drying.

Table 1 reports the materials used in Examples 1 through 10, the composition of the treatment liquids, the treatment conditions, and the quantities of metal deposition. Immersion was used as the treatment method in all cases. The galvanized steel sheet serving as the treatment substrate was an electrogalvanized (EG) steel sheet with a sheet thickness of 0.45 mm, sheet width of 200 mm, length of 300 mm, and plating of 20 $g/m^2$. A bakable aminoalkyd paint (DELICON TM 700 from Dai Nippon Toryo) was applied to a thickness of 30 micrometers using a bar coater. The application of paint was followed by baking for 30 minutes at 120 degrees Centigrade.

With regard to the post-coating evaluation, salt spray testing was carried out in order to evaluate the corrosion resistance, and the primary physical properties (cross-cut adhesion test, Erichsen test) and secondary physical properties (cross-cut adhesion test, Erichsen test) were measured as described in more detail below in order to evaluate film adhesion. The results obtained are reported in Table 2.

1. The line interval in the cross-cut adhesion test for primary physical properties was 1 millimeter ("mm"), and the number of remaining squares (out of a total of 100 squares) after tape lift off was reported according to the following five level scale.

| Number of Remaining Squares: | 100 | 90–99 | 50–89 | 10–49 | 0–9 |
|---|---|---|---|---|---|
| Score: | 5 | 4 | 3 | 2 | 1 |

2. The Erichsen test for the primary physical properties used a 5 mm extrusion, and the residual film area after tape lift-off was reported after conversion using the same five level scale as for part I.1.

3. The cross-cut adhesion test for secondary physical properties was conducted as follows: the painted sheet was immersed in boiling water for 30 minutes, then allowed to stand in a room for 24 hours, and then subjected to cross-cut adhesion testing as in part I.1 above.
4. The Erichsen test for secondary physical properties was conducted as follows: the painted sheet was immersed in boiling water for 30 minutes, then allowed to stand in a room for 24 hours, and then subjected to Erichsen testing as in part I.2 above.
5. The salt-spray test was conducted as follows: the painted sheet was scribed with a cross-form cut using a cutter and then tested for 120 hours in accordance with JIS Z-2371. The development of white rust was measured on the plane surface of the painted sheet while the average lift-of f width was measured for tape lift-off in the cut region. These values were reported after conversion according to the following five level scales:

| | For the Plane Surface | | | | |
|---|---|---|---|---|---|
| Percentage of Area with White Rust Development | <1 | 1-<11 | 11-<26 | 26-<51 | 51-100 |
| Score | 5 | 4 | 3 | 4 | 1 |
| | For the Cut Region | | | | |
| Width in mm of Area Peeled Away Around the Cut | <0.5 | 0.5-<3 | 3-<7 | 7-<13 | ≧13 |
| Score | 5 | 4 | 3 | 2 | 1 |

II. Examples C1 to C10 concern the preparation of an undercoating for painting through treatment of galvanized steel sheet with a treatment liquid according to the present invention, rinsing with water, and a subsequent chromate treatment. Comparison Examples C1 to C5 are for comparison in this regard.

The galvanized steel sheet serving as the treatment substrate was hot-dip galvanized steel sheet (GI) with a sheet thickness of 0.35 mm, a sheet width of 200 mm, a length of 300 mm, and coating of 90 g/m$^2$ of zinc. The respective treatments were implemented according to the conditions described in Table 3, were followed by a water rinse and drying, and afforded the metal add-ons also reported in Table 3. Spraying was employed as the treatment method in all cases, and the spray pressure was 0.5 kilograms (force) per square centimeter ("kgf/cm$^2$"). A coating type chromate treatment liquid having a pH of 2.8 and containing 25 g/L of $Cr^{6+}$, 12 g/L of $Cr^{3+}$, 60 g/L of fumed silica, and 40 g/L of solids from an acrylic resin emulsion was then applied to each sheet by using a roll coater followed by drying. (This is a conventional undercoating treatment for galvanized sheet to be painted.) The film weights obtained were 40 to 60 mg/m$^2$ as Cr add-on. The sheets obtained were then coated with paint for colored galvanized sheet: First a primer (FG64 from Dainippon Ink & Chemicals) was applied to give a dry film thickness of 5 micrometers, baked in a hot-air drying oven with a maximum attained metal plate temperature (MPT) of 210 degrees Centigrade. Finally, top coated sheet was prepared by the application of a 13 micrometer thick PE Blue top coat (from Dainippon Ink & Chemicals), using a bar coater, and baking in a hot-air drying oven at MPT =210 degrees Centigrade.

Additionally, sheet which had been treated up to and including the chromate treatment as described above was coated, using a bar coater, with a conventional back coat (VB-4, from Dai Nippon Toryo Company, Limited) to a thickness of 7 micrometers, and this was baked in a hot-air drying oven at MPT=210 degrees Centigrade to afford back coated sheet.

The top coated sheets were subjected to a bending test and salt spray testing, and the back coated sheets were subjected to salt spray testing.

The severity of the bending test varies according to the number of sheets inserted during bending, and is reported as 0T, 2T, etc., in correspondence to the number of inserted sheets. Also, the test temperature exercises an effect, and a lower temperature corresponds to greater severity. After bending in the bending test and tape lift-off, the lifted off or peeled area was reported according to the following five level scale:

| Percentage of Area with Paint Peeled | <1 | 1-<11 | 11-<26 | 26-<51 | 51-100 |
|---|---|---|---|---|---|
| Score | 5 | 4 | 3 | 2 | 1 |

In the salt spray tests, the status of the plane surface and cut region was evaluated by the same methods and reported according to the same scales as in part I.5 above, after 2,000 hours of salt spray for the top coat and after 500 hours for the back coat. These results are reported in Table 4.

III. Examples D1 to D10 concern the preparation of an undercoating f or painting in which galvanized steel sheet was treated with treatment liquid according to the present invention, rinsed with water, and then subjected to a chromate treatment. Comparison Examples D1 to D5 provide comparisons in this regard.

The galvanized steel sheet serving as the treatment substrate was galvannealed steel sheet (GA) with a sheet thickness of 0.35 mm, sheet width of 200 mm, length of 300 mm, and coating of 60 g/m$^2$ of zinc. The respective treatments were implemented according to the conditions described in Table 5, followed by a water rinse and drying, to afford the metal add-ons also reported in Table 5. Spraying was employed as the treatment method in all cases, and the spray pressure was 0.5 kgf/cm$^2$. A coating type chromate treatment liquid having a pH of 2.8 and containing 25 g/L of $Cr^{6+}$, 12 g/L of $Cr^{3+}$, 60 g/L of fumed silica, and 40 g/L of nonvolatiles from an acrylic resin emulsion, was then applied to each sheet by a roll coater, followed by drying. (This is a conventional undercoating treatment for galvanized sheet to be painted.) The film weights obtained were 40 to 60 mg/m$^2$ as Cr add-on. The sheets obtained were then coated with a conventional paint combination for colored galvanized sheet: First, a primer (FG64 from Dainippon Ink & Chemicals), was applied to give a dry film thickness of 5 micrometers and baked in a hot air drying oven with MPT=210 degrees Centigrade. Finally, top coated sheet was prepared by the application of in oil free polyester paint as top coat (13 micrometers), using a bar coater and then baking in a hot air drying oven at MPT=210 degrees Centigrade.

Additionally, sheet which had been treated up to and including the chromate treatment as described above was coated, using a bar coater, with an alkyd paint back coat (7 micrometers), and this was baked in a hot air drying oven at MPT=210 degrees Centigrade to afford back coated sheets.

The top coat paint was subjected to a bending test and salt spray testing, and the back coated sheet was subjected to salt spray testing.

The severity of the bending test varies according to the number of sheets inserted during bending, and is reported as 0T, 2T, etc., in correspondence to the number of inserted sheets. Also, the test temperature exercises an effect, and a lower temperature corresponds to greater severity. The test results were obtained in the same manner and reported according to the same scales as in part II, except that the salt spray was continued for 1,000 hours for the top coated samples and for 360 hours for the back coated samples. These results are reported in Table 6.

IV. Examples E1 to E10 also concern the preparation of an undercoating for painting in which galvanized steel sheet was treated with treatment liquid according to the present invention, rinsed with water, and then subjected to a chromate treatment. Comparison Examples E1 to E5 provide comparisons in this regard.

The galvanized steel sheet serving as the treatment substrate for these examples was galvaluminum steel sheet (GL), i.e., steel sheet coated with an alloy of about 45% Zn and 55% Al, with a sheet thickness of 0.35 mm, sheet width of 200 mm, length of 300 mm, and coating of go g/m$^2$. The pretreatments according to the invention or for comparison were implemented according to the conditions described in Table 7, followed by a water rinse and drying, to afford the metal add-ons also reported in Table 7. Spraying was employed as the treatment method in all examples of this group, and the spray pressure was 0.5 kgf/cm$^2$. The samples thus pretreated were given a chromating treatment followed by either a top coating treatment or a back coating treatment by the same methods, then tested by the same tests, and test results were reported on the same scales, as in part II above, except that the salt spray times were 1000 hours for top coated samples and 500 hours for back coated samples. The results are reported in Table 8.

V. Examples P1 to P10 concern the preparation of an undercoating for painting in which zinc coated steel sheet was treated with treatment liquid according to the present invention, rinsed with water, and then subjected to a phosphating treatment. Comparison Examples P1 to P5 provide comparisons in this regard.

The zinc coated steel sheets serving as the substrates for these examples had a sheet thickness of 0.7 mm, sheet width of 200 mm, length of 300 mm, and an electroplated coating of 20 g/m$^2$ of an alloy of about 88% Zn and 12% Ni. Treatments according to the invention or for comparison were implemented according to the conditions described in Table 9, followed by a water rinse, to afford the cobalt add-ons also reported in Table 9. (Only cobalt add-on values were determined for these samples, because the presence of nickel in substantial amounts in the zinc alloy coating made the determination of the nickel add-on value technically difficult.) Immersion was employed as the treatment method for all of these examples. This was followed first by a surface-conditioning treatment in the form of a 20 second spray with 1 g/L PREPALENE ZN TM (commercially available from Nihon Parkerizing company, Limited, Tokyo); then immediately, without a water rinse, by an immersion treatment for 2 minutes at 40 degrees Centigrade in a phosphating treatment bath (containing PALBOND L3004 TM from Nihon Parkerizing Company, Limited), followed by electrocoating to a thickness of 20 microns with ELECRON 910 TM from Kansai Paint Company, Limited) ; then finally by a water rinse. The sheet was then processed with a standard paint system for car body panels: intermediate coating of AMILAC SEALER TM (from Kansai Paint), 30 micrometers; final coating of AMILAC WHITE M3 TM, 40 micrometers. Secondary adhesion water-resistance testing was then conducted under the following conditions, and these results are reported in Table 10.

Secondary adhesion water-resistance test

The tricoated sheet was immersed in deionized water at 40 degrees Centigrade for 240 hours and then scribed with 100 cross-cut squares with a one mm interval using an acrylic cutter so as to reach the base metal of the painted sheet. After lift off with cellotape, the number of squares retaining paint was reported according to the following five level scale:

| Number of Paint Retaining Squares: | 100 | 90–99 | 50–89 | 10–49 | 0–9 |
|---|---|---|---|---|---|
| Score: | 5 | 4 | 3 | 2 | 1 |

VI. Examples K1 to K10 concern the treatment of galvanized steel sheet with treatment liquid according to the present invention, followed by a water rinse and then a bakable chromate type blackening treatment. Comparison Examples K1 to K5 provide comparison in this regard.

The galvanized steel sheet serving as the treatment substrate was electrogalvanized steel sheet (EG) with a sheet thickness of 0.45 mm, sheet width of 200 mm, length of 300 mm, and plating of 20 g/m$^2$. Treatments according to the invention or for comparison were implemented according to the conditions described in Table 11, followed by a water rinse and drying, to afford the metal add-ons also reported in Table 11. Immersion was employed as the treatment method for all examples in this group. A bakable chromate type blackening treatment bath having a pH of 2.2 and containing 80 g/L of $Cr^{6+}$, 40 g/L of $Cr^{3+}$, and 40 g/L of nonvolatiles from an acrylic resin emulsion was then applied to each sheet by grooved roll coating to give a dry film thickness of 3 micrometers, followed by drying in a hot air drying oven at MPT of 200 degrees Centigrade to afford baked and blackened galvanized steel sheet.

These blackened galvanized steel sheets were subjected to bending tests in order to evaluate the adhesion between the blackening film and substrate, while salt spray testing was conducted in order to evaluate the corrosion resistance. The bending tests were carried out with 2 T. In the salt spray tests, the area of white rust development on the plane surface was evaluated after 96 hours and was reported according to the same five level scale as in part I.5. The bending test result were reported according to the following scale:

| Percentage of Area with Paint Peeled | <1 | 1–<6 | 6–<26 | 26–<51 | 51–100 |
|---|---|---|---|---|---|

-continued

These results are reported in Table 12.

TABLE 1

| number | substrate | metal ion added type | metal ion added concentration g/L | complexing agent type | complexing agent concentration g/L | additive type | additive concentration g/L | pH | T °C. | treatment time sec | metal deposition (Ni + Co) mg/m² |
|---|---|---|---|---|---|---|---|---|---|---|---|
| Example 1 | EG | Ni | 2.0 | ethylenediamine | 15 | — | — | 7.5 | 40 | 15 | 12 |
| Example 2 | EG | Ni | 2.0 | ammonia | 15 | — | — | 7.5 | 40 | 15 | 40 |
| Example 3 | EG | Ni | 2.0 | ethylenediamine | 15 | NaSCN | 0.07 | 7.5 | 40 | 15 | 26 |
| Example 4 | EG | Co | 0.04 | ammonia | 5 | $NaNO_2$ | 1.0 | 9.5 | 40 | 60 | 18 |
| Example 5 | EG | Ni | 1.0 | diethylenetrimine | 10 | $NaClO_4$ | 0.5 | 7.0 | 40 | 30 | 30 |
| | | Co | 1.0 | glutamic acid | 5 | $NaH_2PO_2$ | 0.8 | | | | |
| Example 6 | EG | Ni | 2.0 | glycine | 5 | $NaNO_3$ | 1.0 | 10.0 | 40 | 60 | 32 |
| | | Co | 0.5 | | | $NaNO_2$ | 0.5 | | | | |
| Example 7 | EG | Ni | 0.5 | triethylenetetramine | 3 | — | — | 5.5 | 40 | 30 | 14 |
| | | Co | 0.5 | ammonia | 5 | | | | | | |
| Example 8 | EG | Co | 2.0 | triethylenetetramine | 4 | $NaH_2PO_2$ | 1.0 | 6.0 | 40 | 15 | 26 |
| | | | | aspartic acid | 0.5 | $SC(NH_2)_2$ | 1.0 | | | | |
| Example 9 | EG | Ni | 3.0 | alanine | 1 | $NO_2$— | 2.0 | 8.5 | 40 | 5 | 24 |
| | | | | ammonia | 5 | $S_2O_3^{2-}$ | 0.5 | | | | |
| Example 10 | EG | Ni | 1.0 | N-methylethylenediamine | 5 | $NO_3$— | 2.0 | 7.0 | 40 | 30 | 38 |
| | | Co | 1.0 | 1,2-diaminopropane | 5 | | | | | | |
| Comparison Example 1 | EG | Co | 1.0 | EDTA 2Na | 5 | — | — | 9.5 | 40 | 60 | 2 |
| Comparison Example 2 | EG | Ni | 1.0 | sodium citrate | 10 | — | — | 8.5 | 40 | 2 | 3 |
| Comparison Example 3 | EG | $CoCO_3$: 16 g/L, HCl (35%): 30 g/L, HF (55%): 3 g/L citric acid: 5 g/L, potassium antimonyl tartrate: 0.822 g/L | | | | | | 2.0 | 60 | 5 | 52 |
| Comparison Example 4 | EG | NaOH: 0.76%, sodium hexahydroxyheptanoate: 0.1% ferric nitrate: 0.0037%, cobalt nitrate: 0.0024% | | | | | | 13.5 | 71 | 60 | 48 |
| Comparison Example 5 | EG | no treatment | | | | | | | | | 0 |

TABLE 2

| Number | primary physical properties: cross-cut adhesion | primary physical properties: Erichsen | secondary physical properties: cross-cut adhesion | secondary physical properties: Erichsen | salt spray, 120 hours: plane surface region | salt spray, 120 hours: cut region |
|---|---|---|---|---|---|---|
| Example 1 | 5 | 5 | 5 | 5 | 5 | 3 |
| Example 2 | 5 | 5 | 5 | 5 | 5 | 4 |
| Example 3 | 5 | 5 | 5 | 5 | 5 | 4 |
| Example 4 | 5 | 5 | 5 | 5 | 5 | 4 |
| Example 5 | 5 | 5 | 5 | 5 | 5 | 4 |
| Example 6 | 5 | 5 | 5 | 5 | 5 | 4 |
| Example 7 | 5 | 5 | 5 | 5 | 5 | 4 |
| Example 8 | 5 | 5 | 5 | 5 | 5 | 4 |
| Example 9 | 5 | 5 | 5 | 5 | 5 | 4 |
| Example 10 | 5 | 5 | 5 | 5 | 5 | 4 |
| Comparison Example 1 | 3 | 2 | 2 | 1 | 2 | 1 |
| Comparison Example 2 | 3 | 2 | 2 | 1 | 2 | 1 |
| Comparison Example 3 | 5 | 5 | 5 | 4 | 1 | 1 |
| Comparison Example 4 | 5 | 5 | 5 | 4 | 1 | 1 |
| Comparison Example 5 | 1 | 1 | 1 | 1 | 1 | 1 |

| Score | 5 | 4 | 3 | 2 | 1 |
|---|---|---|---|---|---|

TABLE 3

| number | substrate | metal ion added type | metal ion added concentration g/L | complexing agent type | complexing agent concentration g/L | additive type | additive concentration g/L | pH | T °C. | treatment time sec | metal deposition (Ni + Co) mg/m² |
|---|---|---|---|---|---|---|---|---|---|---|---|
| Example C1 | GI | Ni | 2.0 | ethylenediamine | 15 | — | — | 7.5 | 60 | 8 | 12 |
| Example C2 | GI | Ni | 2.0 | ammonia | 5 | — | — | 7.5 | 60 | 8 | 46 |
| Example C3 | GI | Ni | 2.0 | ethylenediamine | 15 | NaSCN | 0.07 | 7.5 | 60 | 8 | 28 |
| Example C4 | GI | Co | 0.04 | ammonia | 5 | $NaNO_2$ | 1.0 | 9.5 | 40 | 60 | 20 |
| Example C5 | GI | Ni | 1.0 | diethylenetrimine | 10 | $NaClO_4$ | 0.5 | 7.0 | 60 | 8 | 28 |
| | | Co | 1.0 | glutamic acid | 5 | $NaH_2PO_2$ | 0.8 | | | | |
| Example C6 | GI | Ni | 2.0 | glycine | 5 | $NaNO_3$ | 1.0 | 10.0 | 60 | 8 | 6 |
| | | Co | 0.5 | | | $NaNO_2$ | 0.5 | | | | |
| Example C7 | GI | Ni | 0.5 | triethylenetetramine | 3 | — | — | 5.5 | 60 | 8 | 8 |
| | | Co | 0.5 | ammonia | 5 | | | | | | |
| Example C8 | GI | Co | 2.0 | triethylenetetramine | 4 | $NaH_2PO_2$ | 1.0 | 6.0 | 60 | 8 | 27 |
| | | | | aspartic acid | 0.5 | $SC(NH_2)_2$ | 1.0 | | | | |
| Example C9 | GI | Ni | 3.0 | alanine | 1 | $NO_2$— | 2.0 | 8.5 | 60 | 8 | 18 |
| | | | | ammonia | 5 | $S_2O_3^{2-}$ | 0.5 | | | | |
| Example C10 | GI | Ni | 1.0 | N-methylethylenediamine | 5 | $NO_3$— | 2.0 | 7.0 | 60 | 8 | 15 |

TABLE 3-continued

| number | sub-strate | metal ion added type | metal ion added concen-tration g/L | complexing agent type | complexing agent concen-tration g/L | additive type | additive concen-tration g/L | pH | T °C. | treat-ment time sec | metal deposition (Ni + Co) mg/m² |
|---|---|---|---|---|---|---|---|---|---|---|---|
| | | Co | 1.0 | 1,2-diaminopropane | 5 | | | | | | |
| Comparison Example C1 | GI | Co | 1.0 | EDTA 2Na | 5 | — | — | 9.5 | 60 | 8 | 0.5 |
| Comparison Example C2 | GI | Ni | 1.0 | sodium citrate | 10 | — | — | 8.5 | 60 | 8 | 0.9 |
| Comparison Example C3 | GI | $CoCO_3$: 16 g/l, HCl (35%): 30 g/L, HF (55%): 3 g/L citric acid: 5 g/L, potassium antimonyl tartrate: 0.822 g/L | | | | | | 2.0 | 60 | 5 | 35 |
| Comparison Example C4 | GI | NaOH: 0.76%, sodium hexahydroxyheptanoate: 0.1% ferric nitrate: 0.0037%, cobalt nitrate: 0.0024% | | | | | | 13.5 | 71 | 60 | 45 |
| Comparison Example C5 | GI | no treatment | | | | | | | | | 0 |

TABLE 4

| Number | top coat bending (25° C.) 0T | top coat bending (25° C.) 2T | top coat bending (5° C.) 0T | top coat bending (5° C.) 2T | top coat salt-spray testing (2,000 hours) plane surface | top coat salt-spray testing (2,000 hours) cut region | back coat salt-spray testing (500 hours) plane surface | back coat salt-spray testing (500 hours) cut region |
|---|---|---|---|---|---|---|---|---|
| Example C1 | 5 | 5 | 3 | 5 | 5 | 3 | 4 | 3 |
| Example C2 | 5 | 5 | 3 | 5 | 5 | 4 | 5 | 4 |
| Example C3 | 5 | 5 | 3 | 5 | 5 | 4 | 5 | 4 |
| Example C4 | 5 | 5 | 3 | 5 | 5 | 4 | 5 | 4 |
| Example C5 | 5 | 5 | 4 | 5 | 5 | 4 | 5 | 4 |
| Example C6 | 5 | 5 | 3 | 5 | 5 | 4 | 5 | 4 |
| Example C7 | 5 | 5 | 3 | 5 | 5 | 4 | 5 | 4 |
| Example C8 | 5 | 5 | 3 | 5 | 5 | 4 | 5 | 4 |
| Example C9 | 5 | 5 | 4 | 5 | 5 | 4 | 5 | 4 |
| Example C10 | 5 | 5 | 3 | 5 | 5 | 4 | 5 | 4 |
| Comparison Example C1 | 2 | 5 | 1 | 1 | 4 | 3 | 4 | 3 |
| Comparison Example C2 | 3 | 5 | 1 | 1 | 4 | 3 | 4 | 3 |
| Comparison Example C3 | 5 | 5 | 3 | 5 | 3 | 2 | 3 | 2 |
| Comparison Example C4 | 5 | 5 | 3 | 5 | 3 | 2 | 3 | 2 |
| Comparison Example C5 | 1 | 2 | 1 | 1 | 1 | 1 | 1 | 1 |

TABLE 5

| number | sub-strate | metal ion added type | metal ion added concen-tration g/L | complexing agent type | complexing agent concen-tration g/L | additive type | additive concen-tration g/L | pH | T °C. | treat-ment time sec | metal deposition (Ni + Co) mg/m² |
|---|---|---|---|---|---|---|---|---|---|---|---|
| Example D1 | GA | Ni | 2.0 | ethylenediamine | 15 | — | — | 7.5 | 60 | 8 | 9 |
| Example D2 | GA | Ni | 2.0 | ammonia | 5 | — | — | 7.5 | 60 | 8 | 18 |
| Example D3 | GA | Ni | 2.0 | ethylenediamine | 15 | NaSCN | 0.07 | 7.5 | 60 | 8 | 25 |
| Example D4 | GA | Co | 0.04 | ammonia | 5 | $NaNO_2$ | 1.0 | 9.5 | 60 | 60 | 14 |
| Example D5 | GA | Ni | 1.0 | diethylenetrimine | 10 | $NaClO_4$ | 0.5 | 7.0 | 60 | 8 | 32 |
| | | Co | 1.0 | glutamic acid | 5 | $NaH_2PO_2$ | 0.8 | | | | |
| Example D6 | GA | Ni | 2.0 | glycine | 5 | $NaNO_3$ | 1.0 | 10.0 | 60 | 8 | 35 |
| | | Co | 0.5 | | | $NaNO_2$ | 0.5 | | | | |
| Example D7 | GA | Ni | 0.5 | triethylenetetramine | 3 | — | — | 5.5 | 60 | 8 | 10 |
| | | Co | 0.5 | ammonia | 5 | | | | | | |
| Example D8 | GA | Co | 2.0 | triethylenetetramine | 4 | $NaH_2PO_2$ | 1.0 | | | | |
| | | | | aspartic acid | 0.5 | $SC(NH_2)_2$ | 1.0 | | | | |
| Example D9 | GA | Ni | 3.0 | alanine | 1 | $NO_2$— | 2.0 | 8.5 | 60 | 8 | 48 |
| | | | | ammonia | 5 | $S_2O_3^{2-}$ | 0.5 | | | | |
| Example D10 | GA | Ni | 1.0 | N-methylethylenediamine | 5 | $NO_3$— | 2.0 | 7.0 | 60 | 8 | 25 |
| | | Co | 1.0 | 1,2-diaminopropane | 5 | | | | | | |
| Comparison Example D1 | GA | Co | 1.0 | EDTA 2Na | 5 | — | — | 9.5 | 60 | 8 | 0.8 |
| Comparison Example D2 | GA | Ni | 0.3 | sodium citrate | 10 | — | — | 8.5 | 60 | 8 | 0.5 |
| Comparison Example D3 | GA | $CoCO_3$: 16 g/L, HCl (35%): 30 g/L, HF (55%): 3 g/L citric acid: 5 g/L, potassium antimonyl tartrate: 0.822 g/L | | | | | | 2.0 | 60 | 5 | 32 |
| Comparison Example D4 | GA | NaOH: 0.76%, sodium hexahydroxyheptanoate: 0.1% ferric nitrate: 0.0037%, cobalt nitrate: 0.0024% | | | | | | 13.5 | 71 | 60 | 30 |
| Comparison Example D5 | GA | no treatment | | | | | | | | | 0 |

TABLE 6

| Number | top coat bending (25° C.) 0T | 2T | bending (5° C.) 0T | 2T | salt-spray testing (1,000 hours) plane surface | cut region | back coat salt spray testing (360 hours) plane surface | cut region |
|---|---|---|---|---|---|---|---|---|
| Example D1 | 5 | 5 | 4 | 5 | 5 | 5 | 5 | 5 |
| Example D2 | 5 | 5 | 4 | 5 | 5 | 5 | 5 | 5 |
| Example D3 | 5 | 5 | 4 | 5 | 5 | 5 | 5 | 5 |
| Example D4 | 5 | 5 | 4 | 5 | 5 | 5 | 5 | 5 |
| Example D5 | 5 | 5 | 4 | 5 | 5 | 5 | 5 | 5 |
| Example D6 | 5 | 5 | 4 | 5 | 5 | 5 | 5 | 5 |
| Example D7 | 5 | 5 | 4 | 5 | 5 | 5 | 5 | 5 |
| Example D8 | 5 | 5 | 4 | 5 | 5 | 5 | 5 | 5 |
| Example D9 | 5 | 5 | 4 | 5 | 5 | 5 | 5 | 5 |
| Example D10 | 5 | 5 | 3 | 5 | 5 | 5 | 5 | 5 |
| Comparison Example D1 | 3 | 5 | 2 | 3 | 5 | 4 | 4 | 4 |
| Comparison Example D2 | 4 | 5 | 2 | 3 | 5 | 4 | 4 | 4 |
| Comparison Example D3 | 5 | 5 | 4 | 5 | 5 | 4 | 4 | 4 |
| Comparison Example D4 | 5 | 5 | 4 | 5 | 5 | 4 | 4 | 4 |
| Comparison Example D5 | 2 | 4 | 1 | 2 | 5 | 4 | 3 | 2 |

TABLE 7

| number | sub-strate | metal ion added type | concen-tration g/L | complexing agent type | concen-tration g/L | additive type | concen-tration g/L | pH | T °C. | treat-ment time sec | metal deposition (Ni + Co) mg/m$^2$ |
|---|---|---|---|---|---|---|---|---|---|---|---|
| Example E1 | GL | Ni | 2.0 | ethylenediamine | 15 | — | — | 7.5 | 65 | 8 | 9 |
| Example E2 | GL | Ni | 2.0 | ammonia | 15 | — | — | 7.5 | 65 | 8 | 21 |
| Example E3 | GL | Ni | 2.0 | ethylenediamine | 15 | NaSCN | 0.07 | 7.5 | 65 | 8 | 27 |
| Example E4 | GL | Co | 0.04 | ammonia | 5 | $NaNO_2$ | 1.0 | 9.5 | 65 | 60 | 17 |
| Example E5 | GL | Ni | 1.0 | diethylenetrimine | 10 | $NaClO_4$ | 0.5 | 7.0 | 65 | 8 | 20 |
| | | Co | 1.0 | glutamic acid | 5 | $NaH_2PO_2$ | 0.8 | | | | |
| Example E6 | GL | Ni | 2.0 | glycine | 5 | $NaNO_3$ | 1.0 | 10.0 | 65 | 8 | 4 |
| | | Co | 0.5 | | | $NaNO_2$ | 0.5 | | | | |
| Example E7 | GL | Ni | 0.5 | triethylenetetramine | 3 | — | — | 5.5 | 65 | 8 | 5 |
| | | Co | 0.5 | ammonia | 5 | | | | | | |
| Example E8 | GL | Co | 2.0 | triethylenetetramine | 4 | $NaH_2PO_2$ | 1.0 | 6.0 | 65 | 8 | 20 |
| | | | | aspartic acid | 0.5 | $SC(NH_2)_2$ | | | | | |
| Example E9 | GL | Ni | 3.0 | alanine | 1 | $NO_2$— | 2.0 | 8.5 | 65 | 8 | 13 |
| | | | | ammonia | 5 | $S_2O_3^{2-}$ | 0.5 | | | | |
| Example E10 | GL | Ni | 1.0 | N-methylethylenediamine | 5 | $NO_3$— | 2.0 | 7.0 | 65 | 8 | 15 |
| | | Co | 1.0 | 1,2-diaminopropane | 5 | | | | | | |
| Comparison Example E1 | GL | Co | 1.0 | EDTA 2Na | 5 | — | — | 9.5 | 65 | 8 | 0.3 |
| Comparison Example E2 | GL | Ni | 1.0 | sodium citrate | 10 | — | — | 8.5 | 65 | 8 | 0.9 |
| Comparison Example E3 | GL | $CoCO_3$: 16 g/l, HCl (35%): 30 g/L, HF (55%): 3 g/L citric acid: 5 g/L, potassium antimonyl tartrate: 0.822 g/L | | | | | | 2.0 | 60 | 5 | 18 |
| Comparison Example E4 | GL | NaOH: 0.76%, sodium hexahydroxyheptanoate: 0.1% ferric nitrate: 0.0037%, cobalt nitrate: 0.0024% | | | | | | 13.5 | 71 | 60 | 38 |
| Comparison Example E5 | GL | no treatment | | | | | | | | | 0 |

TABLE 8

| Number | top coat bending (25° C.) 0T | 2T | bending (5° C.) 0T | 2T | salt-spray testing (1,000 hours) plane surface | cut region | back coat salt spray testing (500 hours) plane surface | cut region |
|---|---|---|---|---|---|---|---|---|
| Example E1 | 4 | 5 | 3 | 5 | 5 | 3 | 4 | 3 |
| Example E2 | 5 | 5 | 3 | 5 | 5 | 3 | 5 | 4 |
| Example E3 | 5 | 5 | 3 | 5 | 5 | 3 | 5 | 4 |
| Example E4 | 5 | 5 | 3 | 5 | 5 | 3 | 5 | 4 |
| Example E5 | 5 | 5 | 4 | 5 | 5 | 3 | 5 | 4 |
| Example E6 | 5 | 5 | 3 | 5 | 5 | 3 | 5 | 4 |
| Example E7 | 5 | 5 | 3 | 5 | 5 | 3 | 5 | 4 |
| Example E8 | 5 | 5 | 3 | 5 | 5 | 5 | 5 | 4 |
| Example E9 | 5 | 5 | 4 | 5 | 5 | 3 | 5 | 4 |

TABLE 8-continued

| Number | top coat bending (25° C.) 0T | 2T | bending (5° C.) 0T | 2T | salt-spray testing (1,000 hours) plane surface | cut region | back coat salt spray testing (500 hours) plane surface | cut region |
|---|---|---|---|---|---|---|---|---|
| Example E10 | 5 | 5 | 3 | 5 | 5 | 3 | 5 | 4 |
| Comparison Example E1 | 2 | 5 | 1 | 1 | 4 | 2 | 4 | 3 |
| Comparison Example E2 | 3 | 5 | 1 | 1 | 3 | 2 | 4 | 3 |
| Comparison Example E3 | 5 | 5 | 3 | 5 | 3 | 2 | 3 | 2 |
| Comparison Example E4 | 5 | 5 | 3 | 5 | 3 | 2 | 3 | 2 |
| Comparison Example E5 | 1 | 3 | 1 | 1 | 3 | 2 | 3 | 2 |

TABLE 9

| number | substrate | metal ion added type | concentration g/L | complexing agent type | concentration g/L | additive type | concentration g/L | pH | T °C. | treatment time sec | metal deposition (Ni + Co) mg/m$^2$ |
|---|---|---|---|---|---|---|---|---|---|---|---|
| Example P1 | Zn—Ni | Ni | 2.0 | ethylenediamine | 15 | — | — | 7.5 | 50 | 15 | — |
| Example P2 | Zn—Ni | Ni | 2.0 | ammonia | 5 | — | — | 7.5 | 50 | 15 | — |
| Example P3 | Zn—Ni | Ni | 2.0 | ethylenediamine | 15 | NaSCN | 0.07 | 7.5 | 50 | 15 | — |
| Example P4 | Zn—Ni | Co | 0.04 | ammonia | 5 | $NaNO_2$ | 1.0 | 9.5 | 50 | 60 | 11 |
| Example P5 | Zn—Ni | Ni | 1.0 | diethylenetrimine | 10 | $NaClO_4$ | 0.5 | 7.0 | 50 | 30 | 12 |
| | | Co | 1.0 | glutamic acid | 5 | $NaH_2PO_2$ | 0.8 | | | | |
| Example P6 | Zn—Ni | Ni | 2.0 | glycine | 5 | $NaNO_3$ | 1.0 | 10.0 | 50 | 60 | 6 |
| | | Co | 0.5 | | | $NaNO_2$ | 0.5 | | | | |
| Example P7 | Zn—Ni | Ni | 0.5 | triethylenetetramine | 3 | — | — | 5.5 | 50 | 30 | 7 |
| | | Co | 0.5 | ammonia | 5 | | | | | | |
| Example P8 | Zn—Ni | Co | 2.0 | triethylenetetramine | 4 | $H_2PO_2$— | 1.0 | 6.0 | 50 | 15 | 13 |
| | | | | aspartic acid | 0.5 | $SC(NH_2)_2$ | 1.0 | | | | |
| Example P9 | Zn—Ni | Ni | 3.0 | alanine | 1 | $NO_2$— | 2.0 | 8.5 | 50 | 5 | — |
| | | | | ammonia | 5 | $S_2O_3^{2-}$ | 0.5 | | | | |
| Example P10 | Zn—Ni | Ni | 1.0 | N-methylethylenediamine | 5 | $NO_3$— | 2.0 | 7.0 | 50 | 30 | 22 |
| | | Co | 1.0 | 1,2-diaminopropane | 5 | | | | | | |
| Comparison Example P1 | Zn—Ni | Co | 1.0 | EDTA 2Na | 5 | — | — | 9.5 | 50 | 60 | 1 |
| Comparison Example P2 | Zn—Ni | Ni | 1.0 | sodium citrate | 10 | — | — | 8.5 | 50 | 2 | — |
| Comparison Example P3 | Zn—Ni | $CoCO_3$: 16 g/L, HCl (35%): 30 g/L, HF (55%): 3 g/L citric acid: 5 g/L, potassium antimonyl tartrate: 0.822 g/L | | | | | | 2.0 | 60 | 5 | 45 |
| Comparison Example P4 | Zn—Ni | NaOH: 0.76%, sodium hexahydroxyheptanoate: 0.1% ferric nitrate: 0.0037%, cobalt nitrate: 0.0024% | | | | | | 13.5 | 71 | 60 | 55 |
| Comparison Example P5 | Zn—Ni | | | no treatment | | | | | | | 0 |

TABLE 10

| Number | substrate | secondary adhesion water resistance |
|---|---|---|
| Example | | |
| P1 | Zn—Ni | 5 |
| P2 | Zn—Ni | 5 |
| P3 | Zn—Ni | 5 |
| P4 | Zn—Ni | 5 |
| P5 | Zn—Ni | 5 |
| P6 | Zn—Ni | 5 |
| P7 | Zn—Ni | 5 |
| P8 | Zn—Ni | 5 |

TABLE 10-continued

| Number | substrate | secondary adhesion water resistance |
|---|---|---|
| P9 | Zn—Ni | 5 |
| P10 | Zn—Ni | 5 |
| Comparison Example | | |
| P1 | Zn—Ni | 2 |
| P2 | Zn—Ni | 2 |
| P3 | Zn—Ni | 3 |
| P4 | Zn—Ni | 3 |
| P5 | Zn—Ni | 1 |

TABLE 11

| number | substrate | metal ion added type | metal ion added concentration g/L | complexing agent type | complexing agent concentration g/L | additive type | additive concentration g/L | pH | T °C. | treatment time sec | metal deposition (Ni + Co) mg/m² |
|---|---|---|---|---|---|---|---|---|---|---|---|
| Example K1 | EG | Ni | 2.0 | ethylenediamine | 15 | — | — | 7.5 | 50 | 30 | 60 |
| Example K2 | EG | Ni | 2.0 | ammonia | 5 | — | — | 7.5 | 50 | 30 | 90 |
| Example K3 | EG | Ni | 2.0 | ethylenediamine | 15 | NaSCN | 0.07 | 7.5 | 50 | 30 | 95 |
| Example K4 | EG | Co | 0.04 | ammonia | 5 | $NaNO_2$ | 1.0 | 9.5 | 50 | 60 | 44 |
| Example K5 | EG | Ni | 1.0 | diethylenetrimine | 10 | $NaClO_4$ | 0.5 | 7.0 | 50 | 30 | 51 |
| | | Co | 1.0 | glutamic acid | 5 | $NaH_2PO_2$ | 0.8 | | | | |
| Example K6 | EG | Ni | 2.0 | glycine | 5 | $NaNO_3$ | 1.0 | 10.0 | 50 | 60 | 40 |
| | | Co | 0.5 | | | $NaNO_2$ | 0.5 | | | | |
| Example K7 | EG | Ni | 0.5 | triethylenetetramine | 3 | — | — | 5.5 | 50 | 60 | 43 |
| | | Co | 0.5 | ammonia | 5 | | | | | | |
| Example K8 | EG | Co | 2.0 | triethylenetetramine | 4 | $NaH_2PO_2$ | 1.0 | 6.0 | 50 | 60 | 132 |
| | | | | aspartic acid | 0.5 | $SC(NH_2)_2$ | 1.0 | | | | |
| Example K9 | EG | Ni | 3.0 | alanine | 1 | $NaNO_2$ | 2.0 | 8.5 | 50 | 30 | 135 |
| | | | | ammonia | 5 | $Na_2S_2O_3$ | 0.5 | | | | |
| Example K10 | EG | Ni | 1.0 | N-methylethylenediamine | 5 | $NaNO_3$ | 2.0 | 7.0 | 50 | 60 | 104 |
| | | Co | 1.0 | 1,2-diaminopropane | 5 | | | | | | |
| Comparison Example K1 | EG | Co | 1.0 | EDTA 2Na | 5 | — | — | 9.5 | 50 | 60 | 2 |
| Comparison Example K2 | EG | Ni | 1.0 | sodium citrate | 10 | — | — | 8.5 | 50 | 2 | 3 |
| Comparison Example K3 | EG | $CoCO_3$: 16 g/L, HCl (35%): 30 g/L, HF (55%): 3 g/L citric acid: 5 g/L, potassium antimonyl tartrate: 0.822 g/L | | | | | | 2.0 | 60 | 5 | 45 |
| Comparison Example K4 | EG | NaOH: 0.76%, sodium hexahydroxyheptanoate: 0.1% ferric nitrate: 0.0037%, cobalt nitrate: 0.0024% | | | | | | 13.5 | 71 | 60 | 55 |
| Comparison Example K5 | EG | no treatment | | | | | | | | | 0 |

TABLE 12

| Number | bending test 2T | salt spray 96 hours |
|---|---|---|
| Example | | |
| K1 | 5 | 4 |
| K2 | 5 | 4 |
| K3 | 5 | 4 |
| K4 | 5 | 4 |
| K5 | 5 | 5 |
| K6 | 5 | 5 |
| K7 | 5 | 5 |
| K8 | 5 | 4 |
| K9 | 5 | 4 |
| K10 | 5 | 4 |
| Comparison Example | | |
| K1 | 1 | 1 |
| K2 | 1 | 1 |
| K3 | 5 | 1 |
| K4 | 5 | 1 |
| K5 | 1 | 1 |

The invention claimed is:

1. A process for treating a cleaned surface of zinc or zinc alloy coated steel sheet with an aqueous surface treating solution comprising nickel or cobalt ions or both and a complexing agent for such ions, subsequently treating the resulting surface with a chromating or baked chromate type blackening treatment, and optionally finally coating the treated surface with an organic protective coating, wherein said surface treating solution has a pH between 5 and 10 inclusive and comprises (A) a total of at least 0.01 g/L of metal ions selected from the group consisting of $Ni^{2+}$ and $Co^{2+}$ ions and (B) a sufficient amount to fully complex the metal ions recited in part (A) of complexing agents selected from the group consisting of ammonia and organic compounds having at least one amino group, and a component (C) selected from the group consisting of nitrite ions, nitrate ions, hypophosphite ions, thiocyanate ions, thiosulfate ions, thiourea, phosphite ions, and perchlorate ions.

2. A process according to claim 1, wherein the concentration of component (A) in the surface treating solution is between 0.01 and 30 g/L.

3. A process according to claim 2, wherein the concentration of component (A) is between 0.02 and 15 g/L.

4. A process according to claim 3, wherein an organic protective coating is included in the process, wherein the amount of the total of cobalt and nickel deposited on the treated surface by treatment with said aqueous surface treating solution comprising nickel or cobalt ions or both and a complexing agent for such ions is between 2 and 150 mg/m².

5. A process according to claim 3, wherein a chromating treatment but not a subsequent organic protective coating is included in the process, wherein the amount of the total of cobalt and nickel deposited on the treated surface by treatment with said aqueous surface treating solution comprising nickel or cobalt ions or both and a complexing agent for such ions is between 0.1 and 5 mg/m².

6. A process according to claim 3, wherein a baked chromate type blackening treatment but not a subsequent organic protective coating is included in the process, and the amount of the total of cobalt and nickel deposited on the treated surface by treatment with said aqueous surface treating solution comprising nickel or cobalt ions or both and a complexing agent for such ions is between 2 and 1000 mg/m².

7. A process according to claim 7, wherein the concentration of component (C) is between 0.001 and 50 g/L.

8. A process according to claim 7, wherein the concentration of component (C) is between 0.005 and 20 g/L.

9. A process according to claim 8, wherein an organic protective coating is included in the process, and the amount of the total of cobalt and nickel deposited on the treated surface by treatment with said aqueous surface treating solution comprising nickel or cobalt ions or both and a complexing agent for such ions is between 2 and 150 $mg/m^2$.

10. A process according to claim 8, wherein a chromating treatment but not a subsequent organic protective coating is included in the process, and the amount of the total of cobalt and nickel deposited on the treated surface by treatment with said aqueous surface treating solution comprising nickel or cobalt ions or both and a complexing agent for such ions is between 0.1 and 5 $mg/m^2$.

11. A process according to claim 8, wherein a baked chromate type blackening treatment but not a subsequent organic protective coating is included in the process, and the amount of the total of cobalt and nickel deposited on the treated surface by treatment with said aqueous surface treating solution comprising nickel or cobalt ions or both and a complexing agent for such ions is between 2 and 1000 $mg/m^2$.

* * * * *